United States Patent [19]

Hickman

[11] 4,203,243

[45] May 20, 1980

[54] RAISED RIB AND STOCK ELEVATOR ATTACHMENT FOR SHOTGUNS

[76] Inventor: Jack L. Hickman, 1809 Plaza Way, Walla Walla, Wash. 99362

[21] Appl. No.: 925,100

[22] Filed: Jul. 17, 1978

[51] Int. Cl.[2] ..... F41C 23/00; F41G 1/42

[52] U.S. Cl. ..... 42/73; 42/1 SR

[58] Field of Search ..... 42/73, 72, 74, 71 R, 42/76 R, 1 S, 1 SR

[56] References Cited

U.S. PATENT DOCUMENTS

| | | | |
|---|---|---|---|
| 56,506 | 7/1866 | Jones | 42/73 |
| 1,088,362 | 2/1914 | Perkins | 42/73 |
| 1,223,476 | 4/1917 | Coller | 42/1 SR |
| 1,323,149 | 11/1919 | Blizard | 42/1 SR |
| 1,323,151 | 11/1919 | Burton | 42/1 SR |
| 1,437,796 | 12/1922 | Fisher | 42/1 SR |
| 1,485,064 | 2/1924 | Berger | 42/1 SR |
| 1,582,063 | 4/1926 | McIntosh | 42/1 SR |
| 1,582,395 | 4/1926 | Haemmerli | 42/73 |
| 1,847,777 | 3/1932 | Morgan | 42/73 |
| 2,066,218 | 12/1936 | Morgan | 42/73 |
| 2,496,854 | 2/1950 | Crank | 42/1 SR |
| 2,787,855 | 4/1957 | Guymon | 42/73 |
| 2,869,271 | 1/1959 | Berg | 42/1 SR |
| 2,874,504 | 2/1959 | Martinek | 42/1 SR |
| 3,171,226 | 3/1965 | Into | 42/1 SR |
| 3,710,496 | 1/1973 | Packmayr et al. | 42/73 |
| 4,010,564 | 3/1977 | Pettit | 42/1 SR |
| 4,055,016 | 10/1977 | Katsenes | 42/73 |

FOREIGN PATENT DOCUMENTS

| | | | |
|---|---|---|---|
| 376364 | 11/1939 | Italy | 42/1 SR |

OTHER PUBLICATIONS

*Trap & Field;* Jan. 1978; p. 7.
*Trap & Field;* Apr. 1977; p. 73.

*Primary Examiner*—Charles T. Jordan
*Attorney, Agent, or Firm*—Wells, St. John & Roberts

[57] ABSTRACT

An attachment is disclosed that functions to elevate a shooter's line of sight above the barrel of a trap gun or other shotgun to both increase his overall field of vision and to reduce the effects of recoil. The attachment includes a raised rib arrangement mountable to the barrel of the shotgun and a stock elevating attachment that is adjustably mounted to the shotgun stock. The rib arrangement is mounted by a number of longitudinally spaced bracket members. The members have provisions for releasably receiving both the shotgun barrel and the rib. This facilitates elevational adjustment of the rib member for proper parallax. The stock elevator assembly is adjustably mounted to the butt of the shotgun stock. It includes a recoil absorbing pad and forwardly extending stock elevator that is smoothly rounded to fit the shooter's cheek. A set screw provided with the elevating assembly enables adjustment of the stock elevator relative to the associated gunstock to set the shooter's eye level at a position in horizontal alignment with the elevated rib member.

12 Claims, 11 Drawing Figures

RAISED RIB AND STOCK ELEVATOR ATTACHMENT FOR SHOTGUNS

BACKGROUND OF THE INVENTION

The present invention relates to sighting attachments for shotguns and more particularly to attachments for elevating a line of sight above a shotgun barrel.

Shotguns typically have a hardwood stock piece that extends from the receiver rearwardly to a butt plate. The stock includes a forward narrow hand grip section rearwardly adjacent the receiver and a vertically flaring cheek piece rearward of the hand grip. Atop the cheek piece is a rounded "comb" upon which the shooter rests his cheek bone or maxilla while aiming and firing the weapon. The angle of the comb as well as the elevational spacing between it and the line of sight varies with different brands of firearms as well as different firearm types. Needless to say, the physical characteristics of shooters also vary, on an even greater scale. It follows that some shooters will find the comb of some firearms more comfortable than others. Aside from comfort, it is very important that the shooter keep his head in as nearly an upright posture as possible in order to maximize his field of vision. This is vitally important to trapshooters who must respond almost instantaneously to fast flying "clay pigeons" in order to score well. The sooner the shooter sees his target, the longer he has to take proper aim and fire.

Shotguns utilized in trapshooting are often specially designed with a comb that is relatively close to the elevation of the gun barrel. They also often include an elevated rib that extends along the length of the barrel to slightly raise the line of sight for the shooter above the gun barrel. This is done for several reasons. Firstly, in trapshooting, many rounds are fired during the competition. The gun barrel therefore becomes heated. Heat waves emanating from the gun barrel tend to obscure the line of sight of the shooter and can adversely affect his final score. Also, it is desirable to elevate the line of sight as discussed above to improve the shooter's field of vision. An additional advantage in elevating the line of sight for the shooter is that the recoil impact is lowered more toward the center of mass of the shooter. The effect of the recoil may therefore be reduced and is felt as a significantly lighter jolt. Further, since the line of recoil force is produced at a lower position along the stock, the resulting moment arm is varied slightly and results in the muzzle end of the shotgun remaining stable, rather than lurching upwardly.

Conventional attachments have been produced that change the elevation of the butt plate or increase the elevation of the rib along a shotgun barrel. However, the two important areas of the firearm, the rib along the barrel and the stock comb, are not taken into consideration together. Supposedly higher ribs and stock arrangements have not been provided because of adaptation problems envisioned due to "parallax" or the convergence of the line of sight of the shooter with the trajectory of the charge. An elevated rib of a fixed nature would produce a line of sight that would converge at a specific point with a charge trajectory. Any target location nearer to or further from that point could not be aimed at with accuracy. Therefore, it becomes desirable to obtain an attachment that includes provisions for adjustably elevating both the rib and comb of a shotgun stock.

DETAILED DESCRIPTION OF A PREFERRED EMBODIMENT

Figure 1:
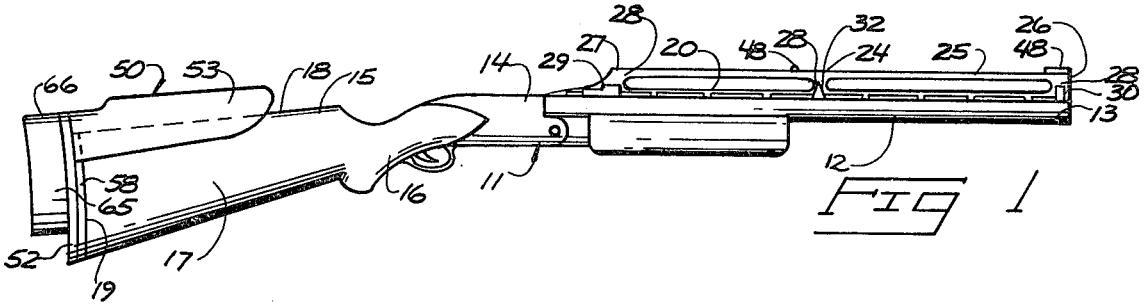
FIG. 1 is a side elevation view of a shotgun with the present invention mounted thereto.

FIG. 1 of the drawings illustrates the present attachment mounted to a shotgun that is generally designated by the reference character 11. For purposes of later discussion, the shotgun includes at least one barrel 12 having a muzzle 13 at a forward end and a receiver 14 at a rearward barrel end. A stock 15 extends rearwardly from the receiver 14. The stock 15 includes a forward portion of reduced cross section that defines a hand grip 16. The stock flares vertically and rearwardly from the hand grip 16, forming a cheek piece 17 that extends to a butt plate 19. The upper ridge of the cheek piece 17 is termed a comb 18.

The shotgun 11 may or may not include a raised rib 20 that extends the length of the barrel 12 between receiver 14 and the muzzle 13. Usually trap guns as illustrated in FIG. 1 provide such a raised rib member 20. Also, the form of shotguns utilized for trapshooting have a comb 18 that is close to horizontal and is somewhat closely spaced from the horizontal plane of the barrel 12. Conversely, shotguns that are utilized for game shooting have barrels that are elevated somewhat from the comb and the comb itself is situated at more of an oblique angle to the plane of the barrel.

It is the function of the present invention to improve the sighting characteristics of trap guns and to adapt field guns for trapshooting sports. Therefore, it may be understood that the below described attachment will be provided for various forms and configurations of shotguns, some significantly different than the example illustrated in FIG. 1.

The present attachment includes a barrel-mountable elongated rib member 24 and a stock elevator attachment that is adapted to fit along the stock and butt plate of a shotgun 11.

The elongated rib member 24 includes a horizontal sighting surface 25 extending between a forward end 26 and a rearward end 27. It is preferred that the rib member 24 be constructed of a single piece of metal such as aluminum or magnesium alloy. Such lightweight material will not significantly hamper the balance of the associated shotgun. The thickness of rib member 24

(FIG. 3) is substantially the same as that of conventional rib 20.

Figure 2:
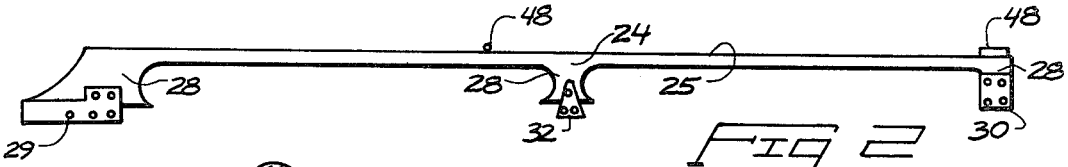
FIG. 2 is a view of the present raised rib and brackets for mounting to a shotgun.

The horizontal sighting surface 25 is located elevationally above the surface of a shotgun barrel when the attachment is mounted thereto. Integral upright standards 28 are provided for this purpose. A rearward standard 28 is provided in the form of an arcuate ramp leading upwardly to the surface 25. A first bracket member 29 is illustrated in FIGS. 1 and 2 for receiving the rearward end 27 of the elongated rib member 24 at standard 28 and for mounting it to the shotgun barrel adjacent to the receiver 14. A second bracket member 30 is also provided to receive the forward standard 28 of rib member 24 and mount it to the shotgun adjacent to the muzzle 13. An intermediate bracket member 32 receives an intermediate standard 28 of rib member 24 and mounts it to the barrel intermediate the breech 14 and muzzle 13.

The bracket members 29, 30, and 32 each include a first clamp means 34 (FIG. 4) that adjustably receives the elongated rib member 24. Each also includes a second clamp means 35 that serves to mount the rib member and bracket to the shotgun barrel.

Figure 4:
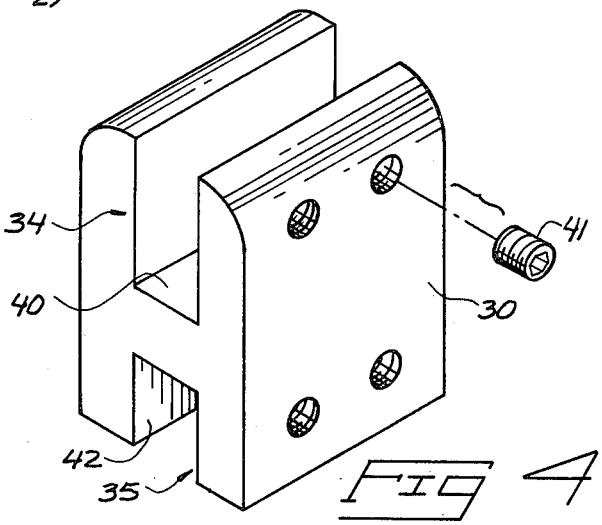
FIG. 4 is an enlarged pictorial view of one of the bracket members of the present invention.

The first clamp means includes upwardly facing recesses 40 that are complementary to the cross-sectional configuration of the standards 28. Set screws such as the example illustrated at 41 in FIG. 4 are utilized to threadably communicate with the bracket members to secure them to the standards 28 received within the recesses 40. Similarly, the second clamp means 35 is comprised of downwardly facing recesses 42 that are complementary to the cross-sectional configuration of a standard raised rib 20.

The attachment may be mounted to and removed from any shotguns without any permanent modification of the original firearm structure.

Figure 5:
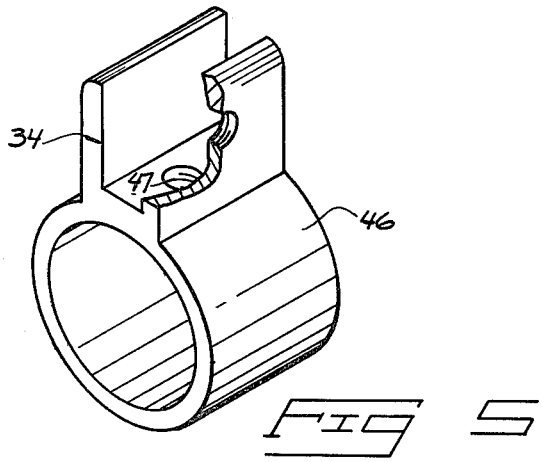
FIG. 5 is a fragmentary enlarged pictorial view of an alternate form of the bracket shown in FIG. 4.
Figure 6:
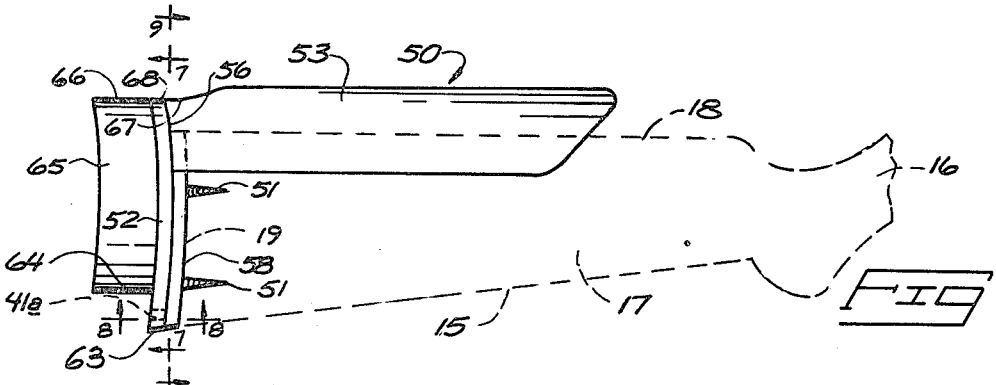
FIG. 6 is an enlarged detail view of the elevator attachment of the present invention.

As briefly discussed above, not all shotguns are provided with the raised rib 20. Often, field guns are provided without elevated ribs of any sort and with sights being a mere bead spaced along the length of the barrel from a groove in the receiver. In order to mount the present raised rib to such shotguns, I provide the form of the bracket members as illustrated in FIG. 5.

Here a ring 46 is utilized in place of the second clamp means 35. It is slidably received over the substantially cylindrical gun barrel and may be firmly attached by a form of the set screw 41 (FIG. 4) communicating through a threaded aperture 47. The first clamp means 34 remains substantially the same as with the form of bracket member illustrated in FIGS. 1 through 4. Again, the mounting is adjustable and requires no permanent modification of the firearm itself.

The elevational distance from the gun barrel to the rearward end 27 of the rib member 24 is somewhat greater than the distance from the muzzle to the surface 25 at the forward end 26. This provision is made to correct for parallax problems that would normally occur with such elevational spacing between the sighting member and the trajectory for the shotgun charge. Further adjustment to compensate for parallax may be made by elevationally adjusting the position of the rib member 24 within the first clamp means 34. For example, if short range shooting is anticipated, the shooter may elevate the rearward end of the rib member slightly within the recess 40 of the first bracket member 29 prior to securing the rib member with the set screws 41. If the shooter anticipates relatively long range shooting he may correct for long range parallax by slightly elevating the forward end 26 of rib member 24 within the recess 40 of second bracket member 30. Such adjustments may be made quickly and in the field.

Figure 3:
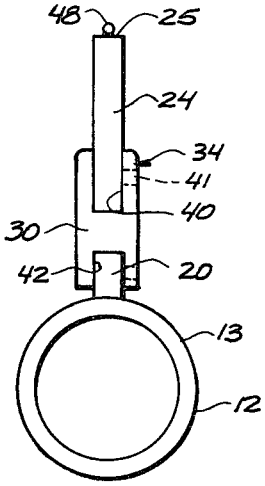
FIG. 3 is an enlarged frontal elevation as seen from the right in FIG. 1.

FIGS. 1 through 3 illustrate the elongated rib member as including a pair of open sight members 48 along the length of the horizontal sighting surface 25. Positioning of these members 48 may be varied along the length of surface 25 or they may be totally eliminated according to the preference of the shooter. It is also contemplated that some form of sighting members may be utilized other than the bead form shown in the drawings.

The present stock elevator attachment is illustrated generally at 50 in FIG. 1. The attachment includes a mounting means that is provided to adjustably and inconspicuously mount the attachment to the gun stock butt plate 19. The mounting means may include an adaptor plate 58 and wood screws 51 that extend through the plate 58 to threadably engage the material at butt plate 19. The adaptor plate 58 includes an upright rib 57 which is received by a complementary slot 60 formed in a recoil plate 52. The recoil plate 52 rigidly mounts a forward projecting stock elevator member 53.

The position of screws 51 is such that no visible means of attachment will be seen along the gunstock. The screws 51 are imbedded within the stock at a position where a conventional butt plate cover (not shown) is normally fitted. Therefore, the stock will not be marred or altered by mounting of the present attachment 50. The screws 51 allow the attachment 50 to be removed and the associated firearm returned easily and conveniently to its original configuration by replacing the original butt plate cover.

Figure 7:
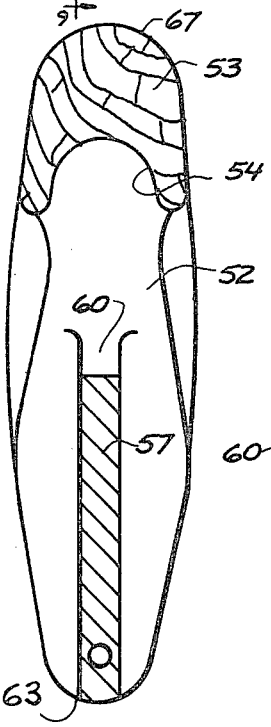
FIG. 7 is an enlarged sectional view taken along line 7—7 in FIG. 6.
Figure 9:
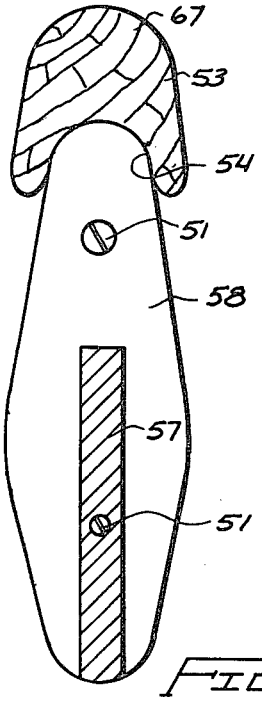
FIG. 9 is an enlarged sectional view taken along line 9—9 in FIG. 6.
Figure 10:
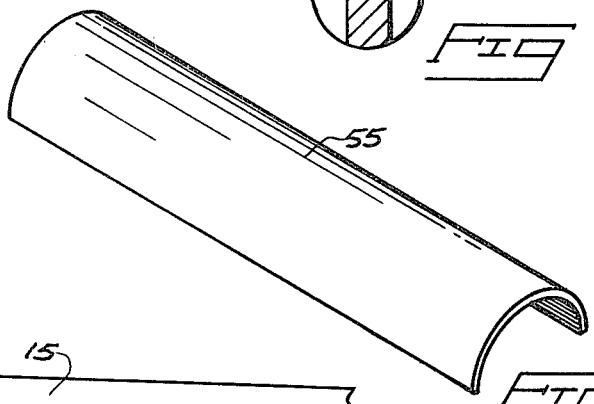
FIG. 10 is a pictorial view of a shim utilized with the present invention.
Figure 11:
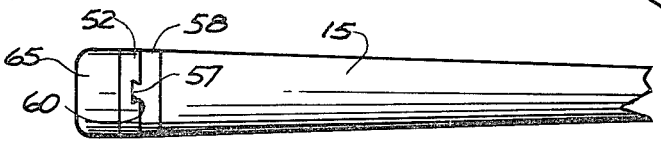
FIG. 11 is a bottom plan view as seen from below in FIG. 6.

The stock elevator member 53 is preferably constructed of hardwood such as walnut or hickory, selected to closely match the shade and grain pattern of the associated gun stock 15. The elevator member 53 includes a concave comb receiving surface 54 that is complementary in cross section (FIGS. 7 and 9) to the comb 18. Surface 54 allows the elevator member 53 to rest snugly against the comb 18. FIG. 5 illustrates a shim 55 of leather or other flexible material that may be placed between the concave surface 54 and comb 18 to prevent scuffing of the stock comb surface against surface 54. Shim 55 may also be used alone or in multiples to facilitate elevational adjustment of the stock elevator 53 relative to the gun stock 15.

An end 56 of the stock elevator member 53 is rigidly affixed to the recoil plate 52. It will therefore move up or downwardly as the plate is moved relative to the gun stock. Standard fastening mechanisms such as screws, bolts, possibly in combination with glue may be utilized to rigidly affix the plate 52 to the elevator member 53.

The configuration of recoil plate 52 is substantially similar but slightly more elongated than the adaptor plate 58. Recoil plate 52 includes the rib receiving slot 60 as part of the mounting means that slidably receives the upright rib 57 of the adaptor plate 58. It is preferred that the rib 57 be a form of dovetail slide that is oriented vertically on plate 58. The rib or slide receiving slot 60 is shaped as a complementary dovetail slot. A lower end of the slot is open to receive rib 57 for elevational adjustment of the stock elevator member and an attached recoil pad 65 relative to stock 15. The dovetail configuration of the interfitting rib and slot serve to secure the attachment elements against any movement other than vertically, relative to the stock 15.

Figure 8:
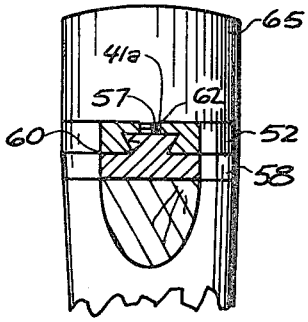
FIG. 8 is an enlarged fragmentary sectional view taken along line 8—8 in FIG. 6.

A lock means 62 is provided to firmly secure plates 52 and 58 against relative movement. It is comprised of a simple set screw as shown at 41*a* (FIG. 8). Set screw 41*a* is threadably engaged within an aperture situated between a bottom end 63 of plate 52 and the bottom 64 of a recoil pad 65. The set screw 41*a* is therefore accessible for quick field adjustment of the attachment 50 relative to the stock 15. It operates to selectively bind the walls of the dovetail slot against the dovetail rib, firmly anchoring the recoil pad in position.

The recoil pad 65 may be of a standard rubberized impact absorbing pad that is affixed by known methods to recoil plate 52. A top 66 of the pad is positioned in alignment with an upper end 68 of the recoil plate 52. An upper curved surface 67 of the stock elevator member 53 is also substantially horizontally aligned with the top of the recoil pad 66 and recoil plate 52. The combined surfaces present a "comb" and butt plate configuration that is similar to standard gun stock configurations with the exception that this assembly is elevated and is elevationally adjustable relative to the associated gun stock.

It may be understood since the recoil pad 65 is elevated from the stock butt plate 19, that the line of recoil impact is lowered. In fact, it is desirable to lower the point of recoil impact. By this arrangement, the contact point of the recoil pad with the shooter's shoulder and the lower line of recoil force form a resultant force that tends to counteract the normal tendency for a muzzle to jump upwardly upon discharge. In addition, although the total recoil impact is the same, it is directed more toward the center of mass of the shooter and is therefore more easily absorbed. The result is that a recoil is not felt by the shooter to be as sharp a blow as would be normally expected. This produces the additional advantage of reducing the tendency of the user to "flinch" prior to discharging the weapon.

I have found from experimentation that the present attachment in some cases actually improves the balance of the associated firearm. In fact, the "swing" during trapshooting may be somewhat improved through the slightly altered balance arrangement. The stock elevator member 53, when properly positioned, prevents the shooter from lowering his head too far. His field of vision is therby maintained. Also, the time is saved that would normally have been used to lower the head, then elevate it to a more correct position. The time gained allows more time for aiming and firing. Actual experiments in trapshooting conditions have resulted in considerably higher scores due to the above improved features.

It is pointed out that the above description and attached drawings are presented merely as examples of a preferred form of the present invention. Neither the description of the drawings are to be taken as restrictions upon the scope of my invention which is set forth only by the following claims.

What I claim is:

1. A raised rib and stock elevator attachment for a shotgun having a barrel, a muzzle at a forward end of the barrel, a receiver at a rearward end of the barrel, a stock rearward of the barrel, a comb along a top side of the stock, and a butt plate at a butt end of the stock; said raised rib and stock elevator attachment comprising:

an elongated rib member having a forward end and a rearward end;

a first bracket member adapted to receive the rearward end of the rib member and mount it to the shotgun upwardly adjacent the barrel at the receiver thereof;

a second bracket member adapted to receive the forward end of the rib member and mount it to the shotgun upwardly adjacent the barrel at the muzzle thereof;

wherein the first and second bracket members each include first clamp means for adjustably securing the rib member to the respective bracket members, and second clamp means adapted to securely mount the rib and bracket members to the shotgun;

a recoil plate;

a stock elevator member on the recoil plate and extending forwardly therefrom;

the stock elevator member having a concave comb receiving surface adapted to engage the comb of the shotgun stock; and mounting means for adjustably securing the recoil plate and stock elevator to the butt plate of the shotgun stock;

wherein the rib member includes a horizontal sighting surface thereon and the stock elevator includes a cheek rest surface mountable to the shotgun at an elevation thereon such that the associated shotgun may be held in a shooting position with the user's eye in horizontal alignment with the sighting surface when his cheek rests against the cheek rest surface.

2. The attachment as defined by claim 1 for a shotgun having a plain barrel of circular cross section, wherein the second clamp means of the first and second bracket members include:

a ring complementary to and adapted to be slidably engaged over the barrel;

a set screw threadably engaged with the clamp means communicating through the ring and adapted to forcibly engage the barrel of the shotgun.

3. The attachment as defined by claim 1 further including an intermediate third bracket adapted to receive a central portion of the rib member and mount it to the shotgun upwardly adjacent the barrel at a point intermediate the receiver and muzzle.

4. The attachment as defined by claim 1 wherein the first clamp means is comprised of recesses formed in the first and second bracket members that are complementary to the cross-sectional configuration of the rib member for receiving the rib member, and set screws threadably engaged with the first and second bracket members and communicating with the recesses to forcibly engage the rib member.

5. The attachment as defined by claim 1 wherein the mounting means is comprised of:

an adaptor plate adapted to be securely mounted to the butt end of the shotgun stock;

an adaptor plate receiving member in the recoil plate slidably receiving the adaptor plate and means for selectively locking the recoil plate to the adaptor plate.

6. The attachment as defined by claim 1 further comprising a recoil pad mounted to the recoil plate.

7. A raised rib attachment for a shotgun with a barrel having a muzzle and a receiver, comprising:

an elongated rib member having a forward end and a rearward end;

a sighting surface extending between the ends of the rib member;

a first bracket member adapted to receive the rearward end of the rib member and mount it to the shotgun upwardly adjacent the barrel at the receiver thereof;

a second bracket member for receiving the forward end of the rib member and adapted to mount it to the shotgun upwardly adjacent the barrel at the muzzle thereof;

wherein the first and second bracket members each include first clamp means for securing the rib member for elevational adjustment relative to the barrel of the shotgun; and second clamp means adapted to securely mount the rib and bracket members to the shotgun.

8. The attachment as defined by claim 7 for a shotgun having a plain barrel of circular cross section, wherein the second clamp means of the first and second bracket members include:

a ring complementary to and adapted to be slidably engaged over the barrel;

a set screw threadably engaged with the clamp means communicating through the ring and adapted to forcibly engage the barrel of the shotgun.

9. The attachment as defined by claim 7 further including an intermediate third bracket adapted to receive a central portion of the rib member and mount it to the shotgun upwardly adjacent the barrel at a point intermediate the receiver and muzzle.

10. The attachment as defined by claim 7 wherein the first clamp means is comprised of recesses formed in the first and second bracket members that are complementary to the cross-sectional configuration of the rib member for receiving the rib member, and set screws threadably engaged with the first and second bracket members and communicating with the recesses to forcibly engage the rib member.

11. The raised rib attachment as defined by claim 7 further comprising open sights on the rib member with a forward sight member adjacent the forward rib end and a rearward sight member spaced directly rearward of the forward sight member along the sighting surface of the rib member.

12. The raised rib attachment as defined by claim 7 wherein the rib member includes integral downwardly projecting standards that are received by the bracket members and wherein one of the standards is located at the rearward end of the rib member and includes an arcuate ramp leading upwardly to the sighting surface.

* * * * *